US010240221B2

(12) United States Patent
Eguchi et al.

(10) Patent No.: US 10,240,221 B2
(45) Date of Patent: Mar. 26, 2019

(54) STAINLESS STEEL SEAMLESS PIPE FOR OIL WELL USE AND METHOD FOR MANUFACTURING THE SAME

(71) Applicant: JFE STEEL CORPORATION, Tokyo (JP)

(72) Inventors: Kenichiro Eguchi, Chita (JP); Yasuhide Ishiguro, Chita (JP)

(73) Assignee: JFE Steel Corporation, Tokyo (JP)

( * ) Notice: Subject to any disclaimer, the term of this patent is extended or adjusted under 35 U.S.C. 154(b) by 767 days.

(21) Appl. No.: 14/761,121

(22) PCT Filed: Jan. 14, 2014

(86) PCT No.: PCT/JP2014/000118
§ 371 (c)(1),
(2) Date: Jul. 15, 2015

(87) PCT Pub. No.: WO2014/112353
PCT Pub. Date: Jul. 24, 2014

(65) Prior Publication Data

US 2015/0354022 A1 Dec. 10, 2015

(30) Foreign Application Priority Data

Jan. 16, 2013 (JP) ..... 2013-005223

(51) Int. Cl.

| | |
|---|---|
| ***C21D 9/14*** | (2006.01) |
| ***C22C 38/02*** | (2006.01) |
| ***C22C 38/42*** | (2006.01) |
| ***C22C 38/44*** | (2006.01) |
| ***E21B 17/00*** | (2006.01) |
| ***C21D 6/00*** | (2006.01) |
| ***C21D 9/08*** | (2006.01) |
| ***C22C 38/00*** | (2006.01) |
| ***C22C 38/58*** | (2006.01) |
| ***C22C 38/04*** | (2006.01) |
| ***C22C 38/06*** | (2006.01) |
| ***C22C 38/46*** | (2006.01) |
| ***C22C 38/48*** | (2006.01) |
| ***C22C 38/50*** | (2006.01) |
| ***C22C 38/54*** | (2006.01) |
| ***C21D 8/10*** | (2006.01) |
| ***C21D 1/22*** | (2006.01) |

(52) U.S. Cl.

CPC ..... *C21D 9/14* (2013.01); *C21D 1/22* (2013.01); *C21D 6/004* (2013.01); *C21D 6/005* (2013.01); *C21D 6/008* (2013.01); *C21D 8/105* (2013.01); *C21D 9/08* (2013.01); *C22C 38/00* (2013.01); *C22C 38/001* (2013.01); *C22C 38/002* (2013.01); *C22C 38/005* (2013.01); *C22C 38/008* (2013.01); *C22C 38/02* (2013.01); *C22C 38/04* (2013.01); *C22C 38/06* (2013.01); *C22C 38/42* (2013.01); *C22C 38/44* (2013.01); *C22C 38/46* (2013.01); *C22C 38/48* (2013.01); *C22C 38/50* (2013.01); *C22C 38/54* (2013.01); *C22C 38/58* (2013.01); *E21B 17/00* (2013.01); *C21D 2211/001* (2013.01); *C21D 2211/008* (2013.01)

(58) Field of Classification Search

CPC ..... C21D 9/14; C22C 38/02; C22C 38/42; C22C 38/44
USPC ..... 148/325, 327, 592
See application file for complete search history.

(56) References Cited

U.S. PATENT DOCUMENTS

| | | | |
|---|---|---|---|
| 7,842,141 | B2 | 11/2010 | Kimura |
| 8,157,930 | B2 | 4/2012 | Amaya |
| 2004/0238079 | A1 | 12/2004 | Kimura |

FOREIGN PATENT DOCUMENTS

| | | |
|---|---|---|
| CN | 1836056 | 9/2006 |
| CN | 101171351 | 4/2008 |
| JP | 62130263 | 6/1987 |
| JP | 0617197 | 1/1994 |
| JP | 08319544 | 12/1996 |
| JP | 101755 | 1/1998 |
| JP | 2001081539 | 3/2001 |

(Continued)

OTHER PUBLICATIONS

English language machine translation of JP 2012149317 to Kimura et al. Generated Feb. 6, 2018.*
Extended European Search Report dated Dec. 10, 2015 for European Application No. 14740356.2-1359.
Japanese Office Action with partial English language translation for Application No. JP 2014-557396, dated Jul. 7, 2015, 5 pages.
International Search Report for International Application No. PCT/JP2014/000118 dated Apr. 1, 2014.

(Continued)

*Primary Examiner* — Brian D Walck
(74) *Attorney, Agent, or Firm* — RatnerPrestia

(57) ABSTRACT

A steel pipe is formed by performing pipe making of a raw material having a composition containing C: 0.05% or less, Si: 0.50% or less, Mn: 0.20% to 1.80%, P: 0.030% or less, S: 0.005% or less, Cr: 14.0% to 18.0%, Ni: 5.0% to 8.0%, Mo: 1.5% to 3.5%, Cu: 0.5% to 3.5%, Al: 0.10% or less, Nb: more than 0.20% and 0.50% or less, V: 0.20% or less, N: 0.15% or less, and O: 0.010% or less, on a percent by mass basis, wherein $Cr+0.65Ni+0.6Mo+0.55Cu-20C \geq 18.5$ and $Cr+Mo+0.3Si-43.3C-0.4Mn-Ni-0.3Cu-9N \leq 11$ are satisfied and subjecting the resulting steel pipe to a quenching treatment to heat to a temperature higher than or equal to the $A_{c3}$ transformation temperature and, subsequently, cool to a temperature of 100° C. or lower at a cooling rate higher than or equal to the air cooling rate and a tempering treatment to temper at a temperature lower than or equal to the $A_{c1}$ transformation temperature.

17 Claims, No Drawings

(56) References Cited

FOREIGN PATENT DOCUMENTS

| | | | |
|---|---|---|---|
| JP | 2004107773 | | 4/2004 |
| JP | 3750596 | | 3/2006 |
| JP | 2008101241 | | 5/2008 |
| JP | 4144283 | | 9/2008 |
| JP | 2009167476 | | 7/2009 |
| JP | 4363327 | | 11/2009 |
| JP | 2012149317 A | * | 8/2012 |
| JP | 2012158798 | | 8/2012 |

OTHER PUBLICATIONS

Chinese Office Action for Chinese Application No. 201480005129.X, dated Mar. 6, 2017 with Concise Statement of Revelance of Office Action—7 Pages.

Chinese Office Action for Chinese Application No. 201480005129.X, dated May 5, 2016, including Concise Statement of Relevance, 20 pages.

Chinese Office Action with partial English language translation for Chinese Application No. 201480005129.X, dated Dec. 1, 2016, 7 pages.

* cited by examiner

STAINLESS STEEL SEAMLESS PIPE FOR OIL WELL USE AND METHOD FOR MANUFACTURING THE SAME

CROSS REFERENCE TO RELATED APPLICATIONS

This is the U.S. National Phase application of PCT/JP2014/000118, filed Jan. 14, 2014, which claims priority to Japanese Patent Application No. 2013-005223, filed Jan. 16, 2013, the disclosures of each of these applications being incorporated herein by reference in their entireties for all purposes.

FIELD OF THE INVENTION

The present invention relates to a stainless steel seamless pipe suitable for use in oil wells, gas wells, and the like of crude oil or natural gases and a method for manufacturing the same. In particular, the present invention relates to improvements of carbon dioxide-corrosion resistance in very severe corrosion environments containing a carbon dioxide ($CO_2$) and chlorine ions ($Cl^-$) at high temperatures up to 230° C. and sulfide stress cracking resistance (SSC resistance) in environments further containing $H_2S$.

BACKGROUND OF THE INVENTION

In recent years, from the viewpoint of exhaustion of oil resources estimated in the near future and because of soaring crude oil prices, deep oil fields which have not been searched and oil fields, gas fields, and the like in severe corrosion environments so-called sour environments containing hydrogen sulfide and the like have been actively developed. In general, such oil fields and gas fields have very large depths and the atmospheres thereof are severe corrosion environments containing $CO_2$, $Cl^-$, and furthermore, $H_2S$ at high temperatures. Oil country tubular goods (OCTG) used in such environments are required to include materials having predetermined high strength and excellent corrosion resistance in combination.

In oil fields and gas fields in environments containing carbon dioxide $CO_2$, chlorine ions $Cl^-$, and the like, in many cases, 13% Cr martensitic stainless steel pipes have been employed as oil country tubular goods used for development drilling. In addition, recently, use of improved version 13% Cr martensitic stainless steel has been spread, where C is reduced and Ni, Mo, and the like are increased in the component system of 13% Cr martensitic stainless steel.

For example, Patent Literature 1 describes an improved version 13% Cr martensitic stainless steel (steel pipe), where the corrosion resistance of the 13% Cr martensitic stainless steel (steel pipe) is improved. The stainless steel (steel pipe) described in Patent Literature 1 is a martensitic stainless steel having excellent corrosion resistance and excellent sulfide stress corrosion cracking resistance, wherein in the composition of martensitic stainless steel containing 10% to 15% of Cr, C is limited to 0.005% to 0.05%, Ni: 4.0% or more and Cu: 0.5% to 3% are added in combination, 1.0% to 3.0% of Mo is further added, and Nieq is adjusted to −10 or more and the microstructure is composed of a tempered martensitic phase, a martensitic phase, and a retained austenitic phase, while a total fraction of tempered martensitic phase and martensitic phase is 60% to 90%. It is mentioned that the corrosion resistance and the sulfide stress corrosion cracking resistance are thereby improved in wet carbon dioxide environments and in wet hydrogen sulfide environments.

Meanwhile, Patent Literature 2 describes a martensitic stainless steel containing, on a percent by mass basis, C: 0.01% to 0.1%, Si: 0.05% to 1.0%, Mn: 0.05% to 1.5%, P: 0.03% or less, S: 0.01% or less, Cr: 9% to 15%, Ni: 0.1% to 4.5%, Al: 0.0005% to 0.05%, and N: 0.1% or less, wherein C+63N satisfies 0.029 to 0.072 and the proof stress is 758 to 965 MPa in a state as cooled or as normalized after hot working. Also, in the technology described in Patent Literature 2, at least one selected from Mo: 0.05% to 3% and Cu: 0.05% to 5.0% and/or at least one selected from Ti: 0.005% to 0.5%, V: 0.005% to 0.5%, and Nb: 0.005% to 0.5% may be further contained. It is mentioned that the proof stress can be thereby specified to be within the range of 758 to 965 MPa and a martensitic stainless steel (steel pipe) with high reliability can be produced.

Also, Patent Literature 3 describes a martensitic stainless steel containing, on a percent by mass basis, C: 0.01% to 0.10%, Si: 0.05% to 1.0%, Mn: 0.05% to 1.5%, P: 0.03% or less, S: 0.01% or less, Cr: 9% to 15%, Ni: 0.1% to 4.5%, Cu: 0.05% to 5%, Mo: 0% to 5%, Al: 0.05% or less, and N: 0.1% or less, wherein Mo+Cu/4 satisfies 0.2% to 5%, the hardness HRC is 30 to 45, and the amount of carbides at primary austenite grain boundaries in the steel is 0.5 percent by volume or less. In the technology described in Patent Literature 3, at least one selected from Ti: 0.005% to 0.5%, V: 0.005% to 0.5%, and Nb: 0.005% to 0.5% may be further contained. It is mentioned that any corrosion resistance of the sulfide stress corrosion cracking resistance, the wear resistance and corrosion resistance, and the localized corrosion resistance can be thereby satisfied even in the use in an environment containing carbon dioxide and a very small amount of hydrogen sulfide.

Also, Patent Literature 4 describes a stainless steel pipe for oil well use, having a steel composition containing, on a percent by mass basis, C: 0.05% or less, Si: 0.50% or less, Mn: 0.20% to 1.80%, P: 0.03% or less, S: 0.005% or less, Cr: 14.0% to 18.0%, Ni: 5.0% to 8.0%, Mo: 1.5% to 3.5%, Cu: 0.5% to 3.5%, Al: 0.05% or less, V: 0.20% or less, N: 0.01% to 0.15%, and O: 0.006% or less, wherein Cr, Ni, Mo, Cu, and C satisfy a specific relationship and, furthermore, Cr, Mo, Si, C, Mn, Ni, Cu, and N satisfy a specific relationship.

In the technology described in Patent Literature 4, at least one selected from Nb: 0.20% or less and Ti: 0.30% or less may be further contained. It is mentioned that a martensitic stainless steel pipe having sufficient corrosion resistance even in severe corrosion environments containing $CO_2$ and $Cl^-$ at high temperatures can be produced.

PATENT LITERATURE

PTL 1: Japanese Unexamined Patent Application Publication No. 10-1755

PTL 2: Japanese Patent No. 3750596 (Japanese Unexamined Patent Application Publication No. 2003-183781)

PTL 3: Japanese Patent No. 4144283 (Japanese Unexamined Patent Application Publication No. 2003-193204)

PTL 4: Japanese Patent No. 4363327 (WO 2004/001082)

SUMMARY OF THE INVENTION

Along with recent development of oil fields, gas fields, and the like in severe corrosion environments, oil country tubular goods have been desired to have high strength and have excellent carbon dioxide-corrosion resistance and excellent sulfide stress cracking resistance (SSC resistance) in combination even in severe corrosion environments containing $CO_2$, $Cl^-$, and furthermore $H_2S$, at high temperatures higher than 200° C. It is mentioned that the technology described in Patent Literature 2 can ensure the yield strength (proof stress) within the predetermined range stably. However, no particular study on an improvement of the corrosion resistance has been performed and it is difficult to say that sufficient corrosion resistance is ensured in severe corrosion environments.

Meanwhile, the technology described in Patent Literature 3 has a problem that the sulfide stress cracking resistance can be held only in a relatively mild environment, where 100% of effective yield stress is loaded in an atmosphere in which a 5% NaCl aqueous solution (environment with solution temperature: 25° C., $H_2S$: 0.003 bar, $CO_2$: 30 bar) is adjusted to pH: about 3.75. Also, the technology described in Patent Literature 4 has a problem that the sulfide stress cracking resistance can be held only in a relatively mild environment, where 100% of effective yield stress is loaded in an atmosphere in which a 5% NaCl aqueous solution (environment with solution temperature: 25° C., $H_2S$: 0.003 bar, $CO_2$: 30 bar) is adjusted to pH: about 3.75.

The present invention aims to solve such problems in the related art and provide a stainless steel seamless pipe for oil well use, having high strength and having excellent carbon dioxide-corrosion resistance and excellent sulfide stress cracking resistance (SSC resistance) in combination, and a method for manufacturing the same.

In this regard, the carbon dioxide-corrosion resistance and the sulfide stress cracking resistance (SSC) may be collectively referred to as the corrosion resistance.

Also, hereafter the term "high strength" refers to the strength in the case of the steel having yield strength: 110 ksi (758 MPa) or more. Also, hereafter the term "excellent sulfide stress cracking resistance" refers to the property of resistance in the case where a test is performed by soaking a specimen in an aqueous solution, in which acetic acid+Na acetate is added to a test solution: 20% NaCl aqueous solution (solution temperature: 25° C., atmosphere of $CO_2$ gas at 0.9 atm and $H_2S$ at 0.1 atm) to adjust the pH to 3.5, for a soaking period of 720 hours while an additional stress of 90% of the yield stress is applied and cracking does not occur in the specimen after the test.

In order to achieve the above-described object, the inventors of the present invention intensively studied various factors affecting the SSC resistance of a stainless steel pipe, which has a Cr-containing composition having an increased Cr content of 14.0 percent by mass or more from the viewpoint of the corrosion resistance, in corrosion environments containing $CO_2$, $Cl^-$, and furthermore, $H_2S$. As a result, the following findings were obtained. When appropriate quenching treatment-tempering treatment was applied to the composition, in which the Cr content was increased, more than 0.20 percent by mass of Nb was further contained and, in addition, Cr, Ni, Mo, Cu, and C and, furthermore, Cr, Mo, Si, C, Mn, Ni, Cu, and N were adjusted to satisfy appropriate relational formulae, a stainless steel seamless pipe having predetermined high strength and having excellent corrosion resistance was able to be produced thereby, where excellent carbon dioxide-corrosion resistance and excellent SSC resistance were ensured in combination in a corrosion atmosphere containing $CO_2$, $Cl^-$, and furthermore, $H_2S$ and in an environment in which a stress in the vicinity of the yield strength was loaded.

Then, according to further studies by the present inventors, the following findings were obtained. The yield ratio increased and the tensile strength TS decreased relative to the yield strength YS by containing a large amount more than 0.20% of Nb. There was a correlation between the tensile strength TS and the sulfide stress cracking susceptibility, so that the cracking susceptibility was reduced because the tensile strength TS was reduced. As a result, it was estimated that the sulfide stress cracking susceptibility was able to be suppressed by adding Nb and, further, the SSC resistance was improved because a Nb-concentrated layer was generated and growth of a pit serving as a starting point of cracking (SSC) was suppressed.

The present invention has been completed on the basis of the above-described findings and additional studies. That is, aspects of the present invention are as described below.

(1) A stainless steel seamless pipe for oil well use, having a composition containing C: 0.05% or less, Si: 0.50% or less, Mn: 0.20% to 1.80%, P: 0.030% or less, S: 0.005% or less, Cr: 14.0% to 18.0%, Ni: 5.0% to 8.0%, Mo: 1.5% to 3.5%, Cu: 0.5% to 3.5%, Al: 0.10% or less, Nb: more than 0.20% and 0.50% or less, V: 0.20% or less, N: 0.15% or less, O: 0.010% or less, and the remainder composed of Fe and incidental impurities, on a percent by mass basis, wherein the following formula (1), $$Cr+0.65Ni+0.6Mo+0.55Cu-20C \geq 18.5 \quad (1)$$

(where Cr, Ni, Mo, Cu, and C: content of each element (percent by mass))

and the following formula (2), $$Cr+Mo+0.3Si-43.3C-0.4Mn-Ni-0.3Cu-9N \leq 11 \quad (2)$$

(where Cr, Ni, Mo, Cu, C, Si, Mn, and N: content of each element (percent by mass))

are satisfied.

(2) The stainless steel seamless pipe for oil well use, according to the item (1), wherein the above-described composition further contains at least one selected from the group consisting of Ti: 0.30% or less, Zr: 0.20% or less, B: 0.01% or less, and W: 3.0% or less on a percent by mass basis.

(3) The stainless steel seamless pipe for oil well use, according to the item (1) or the item (2), wherein the above-described composition further contains at least one selected from the group consisting of REM: 0.0005% to 0.005%, Ca: 0.0005% to 0.01%, and Sn: 0.20% or less on a percent by mass basis.

(4) The stainless steel seamless pipe for oil well use, according to any one of the items (1) to (3), having a microstructure including 25% or less of retained austenitic phase and the remainder composed of martensitic phase on a volume fraction basis.

(5) The stainless steel seamless pipe for oil well use, according to the item (4), wherein the above-described microstructure further includes 5% or less of ferritic phase on a volume fraction basis.

(6) A method for manufacturing a stainless steel seamless pipe for oil well use, including the steps of forming a steel pipe by performing pipe making of a steel pipe raw material having a composition containing C: 0.05% or less, Si: 0.50% or less, Mn: 0.20% to 1.80%, P: 0.030% or less, S: 0.005% or less, Cr: 14.0% to 18.0%, Ni: 5.0% to 8.0%, Mo: 1.5% to 3.5%, Cu: 0.5% to 3.5%, Al: 0.10% or less, Nb: more than 0.20% and 0.50% or less, V: 0.20% or less, N: 0.15% or less, O: 0.010% or less, and the remainder composed of Fe and incidental impurities, on a percent by mass basis, wherein the following formula (1), $$Cr+0.65Ni+0.6Mo+0.55Cu-20C \geq 18.5 \quad (1)$$

(where Cr, Ni, Mo, Cu, and C: content of each element (percent by mass)) and the following formula (2), $$Cr+Mo+0.3Si-43.3C-0.4Mn-Ni-0.3Cu-9N \leq 11 \quad (2)$$

(where Cr, Ni, Mo, Cu, C, Si, Mn, and N: content of each element (percent by mass)) are satisfied and subjecting the resulting steel pipe to a quenching treatment to heat to a temperature higher than or equal to the $A_{c3}$ transformation temperature and, subsequently, cool to a temperature of 100° C. or lower at a cooling rate higher than or equal to the air cooling rate and a tempering treatment to temper at a temperature lower than or equal to the $A_{c1}$ transformation temperature.

(7) The method for manufacturing a stainless steel seamless pipe for oil well use, according to the item (6), wherein the above-described composition further contains at least one selected from the group consisting of Ti: 0.30% or less, Zr: 0.20% or less, B: 0.01% or less, and W: 3.0% or less on a percent by mass basis.

(8) The method for manufacturing a stainless steel seamless pipe for oil well use, according to the item (6) or the item (7), wherein the above-described composition further contains at least one selected from the group consisting of REM: 0.0005% to 0.005%, Ca: 0.0005% to 0.01%, and Sn: 0.20% or less on a percent by mass basis.

According to aspects of the present invention, a martensitic stainless steel pipe having excellent carbon dioxide-corrosion resistance in corrosion environments containing $CO_2$ and $Cl^-$ at high temperatures up to 230° C., excellent sulfide stress cracking resistance (SSC resistance) in corrosion environments further containing $H_2S$ and having high strength of yield strength YS: 758 MPa or more can be produced relatively inexpensively, so that industrially considerably advantageous effects are exerted.

DETAILED DESCRIPTION OF EMBODIMENTS OF THE INVENTION

A stainless steel seamless pipe according to aspects of the present invention has a composition containing C: 0.05% or less, Si: 0.50% or less, Mn: 0.20% to 1.80%, P: 0.030% or less, S: 0.005% or less, Cr: 14.0% to 18.0%, Ni: 5.0% to 8.0%, Mo: 1.5% to 3.5%, Cu: 0.5% to 3.5%, Al: 0.10% or less, Nb: more than 0.20% and 0.50% or less, V: 0.20% or less, N: 0.15% or less, O: 0.010% or less, and the remainder being Fe and incidental impurities, on a percent by mass basis, wherein Cr, Ni, Mo, Cu, and C satisfy the following formula (1), $$Cr+0.65Ni+0.6Mo+0.55Cu-20C \geq 18.5 \quad (1)$$

and Cr, Ni, Mo, Cu, C, Si, Mn, and N satisfy the following formula (2), $$Cr+Mo+0.3Si-43.3C-0.4Mn-Ni-0.3Cu-9N \leq 11 \quad (2).$$

To begin with, reasons for the limitation of the composition of the steel pipe according to aspects of the present invention will be described. Hereafter "percent by mass" is simply expressed as "%" unless otherwise specified.

C: 0.05% or Less

Carbon is an important element relating to the strength of a martensitic stainless steel. In some embodiments of the present invention, the content of 0.01% or more is desirable in order to ensure predetermined strength. On the other hand, if the content is more than 0.05%, sensitization in tempering due to presence of Ni is enhanced. Therefore, C is limited to 0.05% or less in some embodiments of the present invention. In this regard, 0.03% or less is preferable from the viewpoint of the carbon dioxide-corrosion resistance and the sulfide stress cracking resistance. The content of 0.01% to 0.03% is more preferable.

Si: 0.50% or Less

Silicon is an element to function as a deoxidizing agent, and the content of 0.05% or more is desirable for this purpose. On the other hand, if the content is more than 0.50%, the hot workability is degraded and, in addition, the carbon dioxide-corrosion resistance is degraded. Therefore, Si is limited to 0.50% or less. In this regard, 0.10% to 0.30% is preferable.

Mn: 0.20% to 1.80%

Manganese is an element to enhance the strength of a steel. In some embodiments of the present invention, it is necessary that the content be 0.20% or more in order to ensure predetermined strength. On the other hand, if the content is more than 1.80%, the toughness is adversely affected. Therefore, Mn is limited to within the range of 0.20% to 1.80%. In this regard, 0.20% to 1.0% is preferable, and 0.20% to 0.80% is more preferable.

P: 0.030% or Less

Phosphorus degrades the corrosion resistance, e.g., carbon dioxide-corrosion resistance, pitting corrosion resistance, and sulfide stress cracking resistance in combination, and therefore, is preferably minimized in some embodiments of the present invention. However, extreme reduction causes soaring of production cost. Consequently, P is limited to 0.030% or less because this range can be reached at an industrially relatively low cost without causing extreme degradation in characteristics. In this regard, 0.020% or less is preferable.

S: 0.005% or Less

Sulfur is an element to degrade the hot workability significantly and hinder stable operation of a pipe production process and, therefore, is preferably minimized. In the case where the content is 0.005% or less, a pipe can be produced by a common process. Consequently, S is limited to 0.005% or less. In this regard, 0.003% or less is preferable.

Cr: 14.0% to 18.0%

Chromium is an element to form a protective film and, thereby, contribute to an improvement of the corrosion resistance. In some embodiments of the present invention, it is necessary that the content be 14.0% or more in order to ensure the corrosion resistance at high temperatures. On the other hand, if the content is more than 18.0%, the hot workability is degraded and, in addition, the stability of the martensitic phase is degraded, so that predetermined high strength is not obtained. Consequently, Cr is limited to within the range of 14.0% to 18.0%. In this regard, 14.5% to 17.5% is preferable. Further preferably, the lower limit is more than 15%.

Ni: 5.0% to 8.0%

Nickel is an element having a function of strengthening a protective film and improving the corrosion resistance. Also, Ni enhances the strength of a steel through forming a solid solution. Such effects become considerable in the case where the content is 5.0% or more. On the other hand, if the content is more than 8.0%, the stability of the martensitic phase is degraded and the strength is reduced. Consequently, Ni is limited to within the range of 5.0% to 8.0%. In this regard, 5.5% to 7.0% is preferable.

Mo: 1.5% to 3.5%

Molybdenum is an element to enhance the resistance to pitting corrosion due to $Cl^-$ and low pH and the content of 1.5% or more is necessary in some embodiments of the present invention. If the content is less than 1.5%, the corrosion resistance in severe corrosion environments is somewhat less than sufficient. On the other hand, Mo is an expensive element, and a large content of more than 3.5% causes soaring of production cost and, in addition, causes generation of δ ferrite, so that degradation in the hot workability and the corrosion resistance is caused. Consequently, Mo is limited to within the range of 1.5% to 3.5%. In this regard, 1.5% to 2.5% is preferable.

Cu: 0.5% to 3.5%

Copper is an element to strengthen a protective film so as to suppress hydrogen penetration into a steel, and enhance the sulfide stress cracking resistance. In order to obtain such effects, the content of 0.5% or more is necessary. On the other hand, if the content is more than 3.5%, grain boundary precipitation of CuS is caused and the hot workability is degraded. Consequently, Cu is limited to within the range of 0.5% to 3.5%. In this regard, 0.5% to 2.5% is preferable.

Al: 0.10% or Less

Aluminum is an element to function as a deoxidizing agent, and in order to obtain such an effect, the content of 0.01% or more is desirable. On the other hand, if the content is large and is more than 0.10%, amounts of oxides become so much that the toughness is adversely affected. Consequently, Al is limited to within the range of 0.10% or less. In this regard, 0.01% to 0.03% is preferable.

Nb: More than 0.20% and 0.50% or Less

Niobium is an important element in accordance with aspects of the present invention, and is an element to suppress the sulfide stress cracking susceptibility and contribute to an improvement of the SSC resistance. As described above, in the case where Nb is contained, the yield ratio increases, and the tensile strength TS is reduced relative to the yield strength YS. There is a correlation between the tensile strength TS and the sulfide stress cracking susceptibility, so that the cracking susceptibility is reduced because the tensile strength TS is reduced. In order to obtain such effects, the content of more than 0.20% is necessary. On the other hand, if the content is large and is more than 0.50%, the toughness is degraded. Consequently, Nb is limited to within the range of more than 0.20% and 0.50% or less. In this regard, 0.30% to 0.45% is preferable.

V: 0.20% or Less

Vanadium is an element to enhance the strength of a steel through precipitation strengthening and, in addition, improve the sulfide stress cracking resistance. In order to obtain such effects, the content of 0.03% or more is desirable. On the other hand, if the content is more than 0.20%, the toughness is degraded. Consequently, V is limited to within the range of 0.20% or less. In this regard, 0.03% to 0.08% is preferable.

N: 0.15% or Less

Nitrogen is an element to improve the pitting corrosion resistance significantly. Such an effect becomes considerable in the case where the content is 0.01% or more. On the other hand, if the content is more than 0.15%, various nitrides are formed and the toughness is degraded. Consequently, N is limited to 0.15% or less. In this regard, 0.03% to 0.15% is preferable, and 0.03% to 0.08% is more preferable.

O (Oxygen): 0.010% or Less

Oxygen (O) is present as oxides in a steel to adversely affect various characteristics and, therefore, is desirably minimized. In particular, if 0 increases and exceeds 0.010%, all the hot workability, the corrosion resistance, and the toughness are degraded significantly. Consequently, 0 is limited to 0.010% or less. In this regard, 0.006% or less is preferable.

In some embodiments of the present invention, furthermore, Cr, Ni, Mo, Cu, and C within the above-described ranges are contained in such a way as to satisfy the following formula (1), $$Cr+0.65Ni+0.6Mo+0.55Cu-20C \geq 18.5 \quad (1)$$

(where Cr, Ni, Mo, Cu, and C: content of each element (percent by mass)).

In the case where Cr, Ni, Mo, Cu, and C are contained while being adjusted to satisfy the formula (1), the corrosion resistance in hot corrosive environments containing $CO_2$ and $Cl^-$ at high temperatures up to 230° C. is improved considerably. Also, in the case where Cr, Ni, Mo, Cu, C, Si, Mn, and N are contained while being adjusted to satisfy the following formula (2), $$Cr+Mo+0.3Si-43.3C-0.4Mn-Ni-0.3Cu-9N \leq 11 \quad (2)$$

(where Cr, Ni, Mo, Cu, C, Si, Mn, and N: content of each element (percent by mass)), the hot workability is improved, the hot workability necessary and sufficient for pipe making of a martensitic stainless steel seamless pipe can be given, and the producibility of the martensitic stainless steel seamless pipe is improved considerably.

The above-described components are basic components. Besides these basic components, at least one selected from the group consisting of Ti: 0.30% or less, Zr: 0.20% or less, B: 0.01% or less, and W: 3.0% or less and/or at least one selected from the group consisting of REM: 0.0005% to 0.005%, Ca: 0.0005% to 0.01%, and Sn: 0.20% or less can be further contained as selective elements, as necessary.

At least one selected from the group consisting of Ti: 0.30% or less, Zr: 0.20% or less, B: 0.01% or less, and W: 3.0% or less Each of Ti, Zr, B, and W is an element to contribute to enhancement of strength and can be selected and contained, as necessary.

Titanium contributes to the above-described enhancement of strength and, in addition, further contributes to an improvement of the sulfide stress cracking resistance. In order to obtain such effects, the content of 0.01% or more is preferable. On the other hand, if the content is more than 0.30%, coarse precipitates are generated and the toughness and the sulfide stress cracking resistance are degraded. Consequently, in the case where Ti is contained, the content is limited to preferably 0.30% or less.

Zirconium contributes to the above-described enhancement of strength and, in addition, further contributes to an improvement of the sulfide stress cracking resistance. In order to obtain such effects, the content of 0.01% or more is desirable. On the other hand, if the content is more than 0.20%, the toughness is degraded. Consequently, in the case where Zr is contained, the content is limited to preferably 0.20% or less.

Boron contributes to the above-described enhancement of strength and, in addition, further contributes to an improvement of the sulfide stress cracking resistance. In order to obtain such effects, the content of 0.0005% or more is desirable. On the other hand, if the content is more than 0.01%, the toughness and the hot workability are degraded. Consequently, in the case where B is contained, the content is limited to preferably 0.01% or less.

Tungsten contributes to enhancement of the above-described strength and, in addition, improves the sulfide stress cracking resistance. In order to obtain such effects, the content of 0.1% or more is desirable. On the other hand, if the content is large and is more than 3.0%, the toughness is degraded. Consequently, W is limited to 3.0% or less. In this regard, 0.5% to 1.5% is preferable.

At least one selected from the group consisting of REM: 0.0005% to 0.005%, Ca: 0.0005% to 0.01%, and Sn: 0.20% or less Each of REM, Ca, and Sn is an element to contribute to an improvement of the sulfide stress cracking resistance and can be selected and contained, as necessary. In order to ensure such effects, it is desirable that REM: 0.0005% or more, Ca: 0.0005% or more, or Sn: 0.02% or more be contained. On the other hand, even when REM: more than 0.005%, Ca: more than 0.01%, or Sn: more than 0.20% are contained, the effect is saturated, an effect commensurate with the content cannot be expected, and there is an economic disadvantage. Consequently, in the case where they are contained, the individual contents are preferably limited to within the range of REM: 0.0005% to 0.005%, Ca: 0.0005% to 0.01%, and Sn: 0.20% or Less.

The remainder other than the above-described components is composed of Fe and incidental impurities.

Next, reasons for the limitation of the microstructure of the stainless steel seamless pipe for oil well use, according to aspects of the present invention, will be described.

It is preferable that the stainless steel seamless pipe for oil well use, according to aspects of the present invention, have the above-described composition and, in addition, have a microstructure including 25% or less of retained austenitic phase on a volume fraction basis or further including 5% or less of ferritic phase on a volume fraction basis, and the remainder composed of martensitic phase (tempered martensitic phase).

In order to ensure predetermined high strength of the stainless steel seamless pipe for oil well use, according to aspects of the present invention, the main phase is specified to be a martensitic phase (tempered martensitic phase). The remainder other than the main phase is a retained austenitic phase or a retained austenitic phase and a ferritic phase.

High toughness can be obtained by including preferably 5% or more of retained austenitic phase on a volume fraction basis in the microstructure. On the other hand, if the content of retained austenitic phase is more than 25% on a volume fraction basis, the strength may be reduced. Consequently, the retained austenitic phase is limited to preferably 25% or less on a volume fraction basis. Further, in order to improve the corrosion resistance, it is preferable that 5% or less on a volume fraction basis of ferritic phase be included. If the content of ferritic phase is more than 5% on a volume fraction basis, the hot workability may be degraded. Consequently, in the case where the ferritic phase is included, the volume fraction is limited to preferably 5% or less.

Next, a preferable method for manufacturing the stainless steel seamless pipe for oil well use, according to aspects of the present invention, will be described.

In accordance with aspects of the present invention, starting material is a stainless steel seamless pipe having the above-described composition. A method for manufacturing the stainless steel seamless pipe serving as the starting material is not necessarily specifically limited and any commonly known method for manufacturing a seamless pipe can be applied.

Preferably, a molten steel having the above-described composition is produced by a common melting process, e.g., a steel converter, and steel pipe raw materials, e.g., a billet, are produced by common methods, e.g., continuous casting process and ingot casting-blooming process. Subsequently, the resulting steel pipe raw material is heated and hot pipe making is performed by using a pipe making process of Mannesmann-plug mill process or Mannesmann-mandrel mill process, which is a common pipe making method, so that a steel seamless pipe having predetermined dimensions and the above-described composition is produced. In this regard, a steel seamless pipe may be produced by hot extrusion process on the basis of a press process. After the pipe making, preferably, the steel seamless pipe is cooled to room temperature at a cooling rate higher than or equal to the air cooling rate. Consequently, a steel pipe microstructure, in which the main phase is a martensitic phase, can be ensured.

In some embodiments of the present invention, following the cooling to room temperature at a cooling rate higher than or equal to the air cooling rate after the pipe making, the steel pipe is further subjected to a quenching treatment to reheat to a temperature higher than or equal to the $A_{c3}$ transformation temperature, preferably 850° C. or higher, hold for preferably 5 min or more, and subsequently, cool to a temperature of 100° C. or lower at a cooling rate higher than or equal to the air cooling rate. Consequently, a finer martensitic phase and higher toughness can be achieved. In this regard, the heating temperature of the quenching treatment is specified to be preferably 850° C. to 1,000° C. from the viewpoint of preventing coarsening of the microstructure. If the heating temperature for the quenching is lower than the $A_{c3}$ transformation temperature (lower than 850° C.), it is not possible to heat to an austenite single phase zone, and a sufficient martensitic microstructure cannot be established by the cooling thereafter, so that predetermined strength cannot be ensured. Consequently, the heating temperature of the quenching treatment is specified to be higher than or equal to the $A_{c3}$ transformation temperature.

Then, the quenching-treated steel pipe is subjected to a tempering treatment. The tempering treatment is specified to be a treatment to heat to a temperature lower than or equal to the $A_{c1}$ transformation temperature and preferably 500° C. or higher, hold for a predetermined time, preferably 10 min or more, and thereafter, perform air cooling. If the tempering temperature becomes too high and is higher than the $A_{c1}$ transformation temperature, a martensitic phase is precipitated after the tempering, so that predetermined high toughness and excellent corrosion resistance cannot be ensured. In this regard, the tempering temperature is specified to be more preferably 550° C. to 650° C. Consequently, the microstructure becomes a microstructure composed of a tempered martensitic phase and a retained austenitic phase or a microstructure further including a ferritic phase and, thereby, a stainless steel seamless pipe having predetermined high strength, predetermined high toughness, and predetermined corrosion resistance is produced.

Up to this point, although the steel seamless pipe has been explained as an example, the present invention is not limited to this. Oil country tubular goods can also be obtained by using a steel pipe raw material having the above-described composition and producing an electric resistance welded steel pipe or UOE steel pipe on the basis of the common steps.

Aspects of the present invention will be further described below with reference to the examples.

EXAMPLES OF THE INVENTION

A molten steel having the composition shown in Table 1 was produced by a steel converter and was cast into a billet (steel pipe raw material) by a continuous casting process. The billet was subjected to pipe making through hot working by using a model seamless rolling mill and air cooling after the pipe making and, thereby, a steel seamless pipe having outside diameter 83.8 mm×thickness 12.7 mm was produced. In Table 1, ○ expresses that Formula (1) or Formula (2) are satisfied and x, deviation from Formula (1) or Formula (2).

Presence or absence of an occurrence of cracking in inner and outer surfaces of the resulting steel seamless pipe was visually observed to evaluate the hot workability. The obtained results are shown in Table 2. In Table 2, ○ expresses no crack and x, crack exists.

A specimen raw material was cut from the resulting steel seamless pipe and was subjected to a quenching treatment to heat and, thereafter, cool under the conditions shown in Table 2. Subsequently, a tempering treatment to heat and air-cool under the conditions shown in Table 2 was performed.

A specimen for microstructure observation was taken from the specimen raw material subjected to the above-described quenching-tempering treatment. The specimen for microstructure observation was etched with a Vilella corrosion solution (1% picric acid, 5% to 15% hydrochloric acid, and ethanol) and the microstructure was photographed with a scanning electron microscope (magnification 1,000 times). The microstructure fraction (percent by volume) of the ferritic phase was calculated by using an image analysis device.

Also, a specimen for retained austenite measurement was taken from the specimen raw material subjected to the quenching-tempering treatment, and X-ray diffraction integrated intensity of each of a (220) plane of γ (austenite) and a (211) plane of α (ferrite) was measured on the basis of X-ray diffraction and conversion to the retained austenitic phase fraction was performed by using the following formula.

$$\gamma(\text{volume fraction})=100/(1+(I\alpha R\gamma/I\gamma R\alpha))$$

where

Iα: integrated intensity of α

Rα: crystallographically theoretically calculated value of α

Iγ: integrated intensity of γ

Rγ: crystallographically theoretically calculated value of γ

In this regard, the fraction of the martensite phase was calculated as the remainder other than these phases.

Meanwhile, a strip specimen specified by API standard (gage length 50.8 mm) was taken from the specimen raw material subjected to the quenching-tempering treatment. A tensile test was performed in conformity with the specification of API and, thereby, tensile characteristics (yield strength YS, tensile strength TS) were determined. Also, a V-notched test bar (thickness 2 mm) was taken from the specimen raw material subjected to the quenching-tempering treatment in conformity with the specification of JIS Z 2242, a Charpy impact test was performed and, thereby, absorbed energy at −40° C. was determined, so that the toughness was evaluated.

In addition, a specimen of thickness 3 mm×width 30 mm×length 40 mm for corrosion test was produced through machining from the specimen raw material subjected to the quenching-tempering treatment and the corrosion test was performed.

The corrosion test was performed by soaking the specimen into a test solution: 20-percent by mass NaCl aqueous solution (solution temperature: 230° C., $CO_2$ gas atmosphere at 30 atm) held in an autoclave and specifying the soaking period to be 14 days. The weight of the specimen after the test was measured and the corrosion rate was determined by calculation on the basis of weight reduction between before and after the corrosion test. Also, presence or absence of pit initiation on the specimen surface after the corrosion test was observed by using a loupe having magnification: 10 times. In this regard, "presence of pitting corrosion" refers to the case where the diameter is 0.2 mm or more.

Also, a round-bar specimen (diameter: 6.4 mmφ) was produced through machining in conformity with NACE TM0177 Method A from the specimen raw material subjected to the quenching-tempering treatment and a SSC resistance test was performed.

The SSC resistance test was performed by soaking the specimen in an aqueous solution, in which acetic acid+Na acetate was added to a test solution: 20-percent by mass NaCl aqueous solution (solution temperature: 25° C., atmosphere of $H_2S$: 0.1 atm and $CO_2$: 0.9 atm), which was held in an autoclave, to adjust to pH: 3.5, for a soaking period of 720 hours while an additional stress of 90% of the yield stress was applied. Presence of crack in the specimen after the test was examined.

The obtained results are shown in Table 2. In Table 2, ○ expresses no crack and X, crack exists.

TABLE 1

| Steel | Chemical component (percent by mass) | | | | | | | | | | | | | |
|---|---|---|---|---|---|---|---|---|---|---|---|---|---|---|
| No. | C | Si | Mn | P | S | Cr | Ni | Mo | Cu | Al | N | V | Nb | Ti, Zr, B, W |
| A | 0.033 | 0.24 | 0.35 | 0.011 | 0.0009 | 14.6 | 6.70 | 2.08 | 1.07 | 0.037 | 0.014 | 0.061 | 0.358 | — |
| B | 0.036 | 0.27 | 0.28 | 0.012 | 0.0010 | 14.4 | 7.68 | 2.00 | 1.02 | 0.030 | 0.006 | 0.054 | 0.410 | W: 0.20 |
| C | 0.022 | 0.21 | 0.35 | 0.021 | 0.0009 | 14.6 | 6.21 | 1.88 | 0.65 | 0.008 | 0.061 | 0.046 | 0.443 | — |
| D | 0.025 | 0.30 | 0.53 | 0.017 | 0.0012 | 15.0 | 5.95 | 1.91 | 0.65 | 0.006 | 0.079 | 0.046 | 0.386 | Ti: 0.080 |
| E | 0.038 | 0.22 | 0.54 | 0.023 | 0.0006 | 14.9 | 6.19 | 2.10 | 0.71 | 0.016 | 0.042 | 0.033 | 0.442 | Ti: 0.075 |
| F | 0.032 | 0.34 | 0.39 | 0.008 | 0.0024 | 15.2 | 7.05 | 1.59 | 0.61 | 0.010 | 0.056 | 0.058 | 0.401 | Zr: 0.063 |
| G | 0.013 | 0.21 | 0.35 | 0.019 | 0.0013 | 15.5 | 6.23 | 2.33 | 1.18 | 0.018 | 0.042 | 0.064 | 0.359 | Ti: 0.075, B: 0.001 |
| H | 0.031 | 0.27 | 0.44 | 0.007 | 0.0012 | 17.2 | 6.40 | 1.52 | 0.67 | 0.022 | 0.096 | 0.037 | 0.388 | Ti: 0.148, Zr: 0.084 |
| I | 0.036 | 0.38 | 0.34 | 0.019 | 0.0013 | 17.1 | 5.98 | 2.76 | 0.72 | 0.014 | 0.034 | 0.053 | 0.350 | — |
| J | 0.048 | 0.25 | 0.41 | 0.022 | 0.0010 | 13.4 | 5.35 | 2.63 | 2.50 | 0.015 | 0.049 | 0.062 | 0.376 | Ti: 0.064 |
| K | 0.027 | 0.21 | 0.37 | 0.007 | 0.0023 | 14.2 | 4.94 | 1.60 | 0.64 | 0.010 | 0.057 | 0.052 | 0.070 | Ti: 0.044, Zr: 0.021 |
| L | 0.038 | 0.29 | 0.45 | 0.025 | 0.0016 | 15.3 | 4.05 | 1.58 | 0.44 | 0.019 | 0.075 | 0.047 | 0.046 | Ti: 0.026 |
| M | 0.023 | 0.17 | 0.31 | 0.017 | 0.0014 | 14.6 | 6.28 | 1.85 | 0.59 | 0.010 | 0.058 | 0.044 | 0.074 | — |
| N | 0.035 | 0.21 | 0.27 | 0.014 | 0.0006 | 14.7 | 6.87 | 1.90 | 1.02 | 0.036 | 0.012 | 0.058 | 0.165 | — |

TABLE 1-continued

| Steel No. | Chemical component (percent by mass) REM, Ca, Sn | O | Formula (1)* Left side value | Adaptation | Formula (2)** Left side value | Adaptation | Remarks |
|---|---|---|---|---|---|---|---|
| A | Sn: 0.09 | 0.0047 | 20.1 | ○ | 8.0 | ○ | Adaptation example |
| B | — | 0.0031 | 20.4 | ○ | 6.8 | ○ | Adaptation example |
| C | REM: 0.002 | 0.0017 | 19.7 | ○ | 8.5 | ○ | Adaptation example |
| D | — | 0.0017 | 19.9 | ○ | 8.8 | ○ | Adaptation example |
| E | — | 0.0021 | 19.8 | ○ | 8.4 | ○ | Adaptation example |
| F | — | 0.0027 | 20.4 | ○ | 7.6 | ○ | Adaptation example |
| G | — | 0.0044 | 21.3 | ○ | 10.2 | ○ | Adaptation example |
| H | Ca: 0.0011 | 0.0025 | 22.0 | ○ | 9.8 | ○ | Adaptation example |
| I | — | 0.0053 | 22.3 | ○ | 11.8 | X | Comparative example |
| J | — | 0.0026 | 18.9 | ○ | 7.3 | ○ | Comparative example |
| K | — | 0.0026 | 18.2 | X | 8.9 | ○ | Comparative example |
| L | Ca: 0.0026 | 0.0023 | 18.4 | X | 10.3 | ○ | Comparative example |
| M | — | 0.0018 | 19.7 | ○ | 8.4 | ○ | Comparative example |
| N | — | 0.0029 | 20.2 | ○ | 7.8 | ○ | Comparative example |

*Cr + 0.65Ni + 0.6Mo + 0.55Cu − 20C ≥ 18.5 . . . (1)

**Cr + Mo + 0.3Si − 43.3C − 0.4Mn − Ni − 0.3Cu − 9N ≤ 11 . . . (2)

TABLE 2

| Steel pipe No. | Steel No. | Quenching treatment: Heating temperature (° C.) | Holding time (min) | Cooling | Cooling stop temperature (° C.) | Tempering treatment: Heating temperature (° C.) | Holding time (min) | Microstructure: Type* | F phase volume fraction (%) | γ phase volume fraction (%) |
|---|---|---|---|---|---|---|---|---|---|---|
| 1 | A | 920 | 20 | air cooling | 30 | 600 | 30 | M | 0 | 0 |
| 2 | B | 920 | 20 | air cooling | 25 | 600 | 30 | M + γ | 0 | 12 |
| 5 | C | 890 | 10 | air cooling | 30 | 530 | 30 | M + F + γ | 2 | 1 |
| 6 | C | 890 | 10 | air cooling | 30 | 610 | 30 | M + F + γ | 1 | 1 |
| 7 | D | 890 | 10 | air cooling | 30 | 530 | 30 | M + F | 2 | 0 |
| 8 | D | 890 | 10 | air cooling | 30 | 610 | 30 | M + F | 2 | 0 |
| 9 | E | 890 | 10 | air cooling | 30 | 580 | 30 | M + F | 2 | 0 |
| 10 | F | 890 | 10 | air cooling | 30 | 580 | 30 | M + F | 1 | 0 |
| 11 | G | 890 | 10 | air cooling | 30 | 580 | 30 | M + F + γ | 3 | 12 |
| 12 | H | 890 | 10 | air cooling | 30 | 550 | 30 | M + F + γ | 4 | 25 |
| 13 | I | 890 | 10 | air cooling | 30 | 580 | 30 | M + F + γ | 6 | 30 |
| 14 | J | 890 | 10 | air cooling | 30 | 580 | 30 | M + γ | 0 | 1 |
| 15 | K | 890 | 10 | air cooling | 30 | 580 | 30 | M + F | 1 | 0 |
| 16 | L | 890 | 10 | air cooling | 30 | 580 | 30 | M + F | 5 | 0 |
| 17 | M | 890 | 10 | air cooling | 30 | 530 | 30 | M + F | 1 | 0 |
| 18 | N | 920 | 20 | air cooling | 30 | 600 | 30 | M + γ | 0 | 11 |

| Steel pipe No. | Tensile characteristics: Yield strength YS (MPa) | Tensile strength TS (MPa) | Toughness $vE_{-40° C.}$ (J) | Hot workability | Corrosion test: Weight loss corrosion rate (mm/y) | Presence of pitting corrosion | SSC resistance test: Presence of crack | Remarks |
|---|---|---|---|---|---|---|---|---|
| 1 | 911 | 978 | 173 | ○ | 0.082 | none | ○ | Invention example |
| 2 | 909 | 990 | 223 | ○ | 0.065 | none | ○ | Invention example |
| 5 | 916 | 1129 | 165 | ○ | 0.110 | none | ○ | Invention example |
| 6 | 874 | 1093 | 182 | ○ | 0.100 | none | ○ | Invention example |
| 7 | 927 | 1117 | 149 | ○ | 0.112 | none | ○ | Invention example |
| 8 | 903 | 1041 | 170 | ○ | 0.108 | none | ○ | Invention example |
| 9 | 908 | 1016 | 159 | ○ | 0.105 | none | ○ | Invention example |
| 10 | 836 | 987 | 188 | ○ | 0.089 | none | ○ | Invention example |
| 11 | 852 | 963 | 236 | ○ | 0.069 | none | ○ | Invention example |
| 12 | 768 | 893 | 302 | ○ | 0.049 | none | ○ | Invention example |
| 13 | 698 | 856 | 323 | X | 0.042 | none | ○ | Comparative example |
| 14 | 915 | 1054 | 173 | ○ | 0.149 | none | X | Comparative example |

TABLE 2-continued

| | | | | | | | | |
|---|---|---|---|---|---|---|---|---|
| 15 | 882 | 938 | 186 | ○ | 0.173 | none | X | Comparative example |
| 16 | 897 | 959 | 162 | ○ | 0.144 | none | X | Comparative example |
| 17 | 902 | 1134 | 157 | ○ | 0.108 | none | X | Comparative example |
| 18 | 967 | 1028 | 201 | ○ | 0.095 | none | X | Comparative example |

*M: martensite, F: ferrite, γ: retained austenite

In each of invention examples, the resulting stainless steel seamless pipe had high strength of yield strength: 758 MPa or more, high toughness of absorbed energy at −40° C.: 40 J or more, and excellent corrosion resistance (carbon dioxide-corrosion resistance) in a corrosion environment containing $CO_2$ and $Cl^-$ at a high temperature up to 230° C. and had excellent sulfide stress cracking resistance, where cracking (SSC) did not occur in an environment further containing $H_2S$, in combination, while being under stress. On the other hand, in each of Comparative examples out of the scope of the present invention, predetermined high strength was not obtained, carbon dioxide-corrosion resistance was degraded, or the sulfide stress cracking resistance. (SSC resistance) was degraded.

The invention claimed is:

1. A stainless steel seamless pipe for oil well use, comprising a composition containing C: 0.05% or less, Si: 0.50% or less, Mn: 0.20% to 1.80%, P: 0.030% or less, S: 0.005% or less, Cr: 14.0% to 18.0%, Ni: 5.0% to 8.0%, Mo: 1.5% to 3.5%, Cu: 0.5% to 3.5%, Al: 0.10% or less, Nb: more than 0.20% and 0.50% or less, V: 0.20% or less, N: 0.15% or less, O: 0.010% or less, and the remainder composed of Fe and incidental impurities, on a percent by mass basis, wherein the following formula (1) and the following formula (2) are satisfied, $$Cr+0,65Ni+0.6Mo+0.55Cu-20C\geq 18.5 \quad (1)$$

$$Cr+Mo+0.351-43.3C-0.4Mn-Ni-0.3Cu-9N\leq 11 \quad (2)$$

where Cr, Ni, Mo, Cu, C, Si, Mn, and N: content of each element (percent by mass).

2. The stainless steel seamless pipe for oil well use, according to claim 1, wherein the composition further contains at least one selected from the group consisting of Ti: 0.30% or less, Zr: 0.20% or less, B: 0.01% or less and W: 10% or less on a percent by mass basis.

3. The stainless, steel seamless pipe for oil well use, according to claim 1, wherein the composition further contains at least one selected from the group consisting of REM: 0.0005% to 0.005% Ca: 0.0005% to 0.01%, and Sn: 0.20% or less on a percent by mass basis.

4. The stainless steel seamless pipe for oil well use, according to claim 1, comprising a microstructure including 25% or less of retained austenitic phase and the remainder composed of martensitic phase on a volume fraction basis.

5. The stainless steel seamless pipe for oil well use, according to claim 4, wherein the microstructure further includes 5% or less of ferritic phase on a volume fraction basis.

6. The stainless steel seamless pipe for oil well use, according to claim 2, wherein the composition further contains at least one selected from the group consisting of REM: 0.0005% to 0.005%, Ca: 0.0005% to 0.01%, and Sn: 0.20% or less on a percent by mass basis.

7. The stainless steel seamless pipe for oil well use, according to claim 2, comprising a microstructure including 25% or less of retained austenitic phase and the remainder composed of martensitic phase on a volume fraction basis.

8. The stainless steel seamless pipe for oil well use, according to claim 3, comprising a microstructure including 25% or less of retained austenitic phase and the remainder composed of martensitic phase on a volume fraction basis.

9. The stainless steel seamless pipe for oil well use, according to claim 6, comprising a microstructure including 25% or less of retained austenitic phase and the remainder composed of martensitic phase on a volume fraction basis.

10. The stainless steel seamless pipe for oil well use, according to claim 7, wherein the microstructure further includes 5% or less of ferritic phase on a volume fraction basis.

11. The stainless steel seamless pipe for oil well use, according to claim 8, wherein the microstructure further includes 5% or less of ferritic phase on a volume fraction basis.

12. The stainless steel seamless pipe for oil well use, according to claim 9, wherein the microstructure further includes 5% or less of ferritic phase on a volume fraction basis.

13. The stainless steel seamless pipe for oil well use, according to claim 1, wherein the composition contains Nb: 0.30% or more and 0.50% or less.

14. A method for manufacturing a stainless steel seamless pipe for oil well use, comprising the steps of forming a steel pipe by performing pipe making of a steel pipe raw material having a composition containing C: 0.05% or less, Si: 0.50% or less, Mn: 0.20% to 1.80%, P: 0.030% or less, S: 0.005% or less, Cr: 14.0% to 18.0%, Ni: 5.0% to 8.0%, Mo: 1.5% to 3.5%, Cu: 0.5% to 3.5%, Al: 0.10% or less, Nb: more than 0.20% and 0.50% or less, V: 0.20% or less, N: 0.15% or less, O: 0.010% or less, and the remainder composed of Fe and incidental impurities, on a percent by mass basis, wherein the following formula (1) and the following formula (2) are satisfied and subjecting the resulting steel pipe to a quenching treatment to heat to a temperature higher than or equal to the transformation temperature and, subsequently, cool to a temperature of 100° C. or lower at a cooling rate higher than or equal to the air cooling rate and a tempering treatment to temper at a temperature lower than or equal to the $A_{c1}$ transformation temperature, $$Cr+0.65Ni+0.6Mo+0.55Cu-20C\geq 18.5 \quad (1)$$

$$Cr+Mo+0.3Si-43.3C-0.4Mn-Ni-0.3Cu-9N\leq 11 \quad (2)$$

where Cr, Ni, Mo, Cu, C, Si, Mn, and N: content of each element (percent by mass).

15. The method for manufacturing a stainless steel seamless pipe for oil well use, according to claim 14, wherein the composition further contains at least one selected from the group consisting of Ti: 0.30% or less, Zr: 0.20% or less, B: 0.01% or less, and W: 3.0% or less on a percent by mass basis.

16. The method for manufacturing a stainless steel seamless pipe for oil well use, according to claim 14, wherein the composition further contains at least one selected from the group consisting of REM: 0.0005% to 0.005%, Ca: 0.0005% to 0.01%, and Sn: 0.20% or less on a percent by mass basis.

17. The method for manufacturing a stainless steel seamless pipe for oil well use, according to claim 15, wherein the composition further contains at least one selected from the group consisting of REM: 0.0005% to 0.005%, Ca: 0.0005% to 0.01% and Sn: 0.20% or less on a percent by mass basis.

* * * * *